US006220781B1

(12) United States Patent
Miller

(10) Patent No.: US 6,220,781 B1
(45) Date of Patent: Apr. 24, 2001

(54) VEHICLE STOPPING DEVICE

(75) Inventor: Douglas Miller, Baltimore City, MD (US)

(73) Assignee: Purple & Green Research, Inc., Baltimore, MD (US)

( * ) Notice: Subject to any disclaimer, the term of this patent is extended or adjusted under 35 U.S.C. 154(b) by 0 days.

(21) Appl. No.: 09/417,042

(22) Filed: Oct. 12, 1999

Related U.S. Application Data

(60) Provisional application No. 60/103,872, filed on Oct. 13, 1998.

(51) Int. Cl.[7] ..... G01F 13/00
(52) U.S. Cl. ..... 404/6; 404/9
(58) Field of Search ..... 404/6, 9; 116/63 P

(56) References Cited

U.S. PATENT DOCUMENTS

| | | | | |
|---|---|---|---|---|
| 4,382,714 | | 5/1983 | Hutchison . | |
| 4,544,303 | * | 10/1985 | Glasmire | 404/6 |
| 4,862,638 | | 9/1989 | Stevenson . | |
| 5,123,774 | | 6/1992 | Dubiel . | |
| 5,322,385 | * | 6/1994 | Reisman | 404/6 |
| 5,328,292 | | 7/1994 | Williams . | |
| 5,451,239 | | 9/1995 | Sewell et al. . | |
| 5,498,102 | | 3/1996 | Bissell . | |
| 6,155,745 | * | 12/2000 | Groen et al. | 404/6 |

* cited by examiner

*Primary Examiner*—Eileen D. Lillis
*Assistant Examiner*—Raymond W Addie
(74) *Attorney, Agent, or Firm*—Harrison & Egbert

(57) ABSTRACT

A vehicle stopping device having a panel of material with a split extending from one end of the panel toward an opposite end of the panel, a tactile surface formed adjacent to one of the panel and adapted to attach to a tire rolling thereover, and a reinforcement sash affixed to the panel of material and extending in a partial loop around the split seam. The reinforcement sash has a first end affixed adjacent to the tactile surface and a second end affixed to the tactile surface on an opposite side of the split seam from the first end. The panel has a width dimension suitable for extending across a roadway. The tactile surface extends across this width dimension. The panel is capable of being folded into a concertina. The tactile surface can be either an adhesive applied onto a top surface of the panel of material, an adhesive retained within a plurality of blisters affixed along a forward edge of the panel of material, or a plurality of barbs extending upwardly from the top surface of the panel of material.

20 Claims, 2 Drawing Sheets

VEHICLE STOPPING DEVICE

RELATED APPLICATION

The present utility patent application is based upon U.S. Provisional Patent Application Ser. No. 60/103,872, filed on Oct. 13, 1998, and entitled "VEHICLE STOPPING DEVICE".

TECHNICAL FIELD

The present invention relates to law enforcement equipment. More particularly, the present invention relates to non-lethal devices employed by police agencies on a roadway during pursuit to safely and almost instantly stop a fleeing vehicle.

BACKGROUND ART

As is perhaps well known, there have recently been several notorious chases of fleeing vehicles whose drivers refuse to stop or try to outrun the police. Some of the most famous chases involved armed and dangerous criminals who had virtually nothing to lose by using their vehicle to crash through classic police roadblocks which often resulted in bodily injury and great property damage.

The classic police roadblock by which police cars are parked across a roadway results in blockage of all vehicular traffic and thereby often causes congestion of citizen drivers at the roadblock who must either be allowed to pass by movement of police cars or risk physical harm in any subsequent confrontation between the police and the driver of a fleeing vehicle. In other words, classic police roadblocks are non-selective, cause congestion and often result in more injury than they are worth.

Accordingly, the prior art reveals attempts to replace classic police roadblocks with a selective and safe means for stopping a fleeing vehicle by puncturing its tires. A preferred device in use today is known as a spike strip and there are several variations, none of which have the advantages of the present invention. One of the earlier known spike strips simply consisted of a narrow length of flat rubber or fabric base containing a multitude of nails oriented in the same direction so that the strip could be coiled for storage in a trunk of a police car, but upon approach of a fleeing vehicle, the coil could be rolled across a roadway in the path of the vehicle whereby the nails would puncture the tires. However, in practice, it soon became apparent that a coil of nails had several inherent problems. First, the nails often snagged upon each other as the coil was unwound and often ensnared itself on other items. Secondly, someone had to physically place the outstretched strip with nails upright in the path of an oncoming vehicle which was usually driven at a very high speed, thereby allowing a few seconds to complete the task. Thirdly, even when initial contact is made between the strip and the fleeing vehicle, it was often seen that solid nails alone did not deflate the tires rapidly enough and the vehicle would continue for several more miles before being disabled. Fourthly, this type of coiled spike strip was non-selective in that any innocent vehicle ahead of the fleeing vehicle on the same roadway would obviously contact the nails and thereby most often result in the entire strip being adhered to the tires and dislodged from the roadway.

In the past, various patents have issued relating to devices for the rapid stopping of vehicles. For example, U.S. Pat. No. 4,382,714, issued on May 10, 1983 to W. G. Hutchison, describes a vehicle disabling device in the form of a plurality of spike-like devices adapted to project perpendicular to a road surface to puncture one or more tires of a fleeing vehicle. A plurality of the devices are interconnected for ease in putting in place and removing as well as creating a flailing effect when engaged.

U.S. Pat. No. 4,544,303, issued on Oct. 1, 1985 to F. G. Glasmire, describes a protective traffic barrier designed to divert motor vehicle traffic away from an object or roadway. This device employs a base with wedge-shaped projections extending vertically from the base so as to impede the movement of a motor vehicle across the barrier. The shape of the base may be designed to fulfill a particular function including an opening to allow the barrier to fit over an object to be protected. A resilient cover encapsulates the base so as to protect people or animals from contact injury with the wedge-shaped projections.

U.S. Pat. No. 5,123,774, issued on Jun. 23, 1992 to J. J. Dubiel, teaches an apparatus for the puncturing of tires. This apparatus employs a plurality of spaced tubular supports which are secured together by a flexible tether line. The respective outer distal tubular support members include a respective outer tether line that is in turn secured to a spike member for projection into the ground surface on opposed sides of a highway structure. Plural pairs of spaced parallel spikes define an acute angle therebetween.

U.S. Pat. No. 5,322,385, issued on Jun. 21, 1994 to R. Reisman, describes an anti-vehicle barrier that includes a pad made of a compressible material. An array of upwardly directed hollow metal spikes are distributed throughout the pad so as to puncture the tire of a vehicle which rides over the pad. The spikes may be removable so that upon puncturing the tire, they are removed from the pad and retained by the punctured tire so as to bring about its rapid deflation. When deployed in the pad, the spikes are flush with or are below the top surface of the pad.

U.S. Pat. No. 5,328,292, issued on Jul. 12, 1994 to F. R. Williams, teaches a traffic barrier which gives law-enforcement officers an effective traffic barrier which can be easily carried in the trunk of a car and quickly deployed across a roadway. The chain is simply stretched across the roadway at a right angle to the direction of traffic and pulled tight. The traffic barrier chain is designed so that no matter how the chain is placed on the road surface, half of the splines will be facing the direction of traffic flow at an angle of 45 degrees.

U.S. Pat. No. 5,498,102, issued on Mar. 12, 1996 to S. Bissell, teaches a tire puncturing spike strip which can be placed on a road surface in front of a moving vehicle. The spike strip is composed of rectangular modular frame units with low height for easy storage in a trunk of a police vehicle. The frame units have interlocking ends which can be quickly assembled in any desired length for placement across a roadway with spikes in a normal down position to allow safe passage of vehicles over the strip. The spikes may be selectively and remotely activated to their up position electromechanically by an operator to target a specific fleeing vehicle. Once the fleeing vehicle crosses over the strip, the spikes may be electromechanically returned to their down position to allow pursuing police cars to safely cross over the strip and apprehend the disabled vehicle.

It is an object of the present invention to provide a vehicle stopping device which rapidly brakes the fleeing vehicle.

It is another object of the present invention to provide a vehicle stopping device which is capable of selective deployment.

It is another object of the present invention to provide a vehicle stopping device which serves to stop both large and small vehicles.

It is another object of the present invention to provide a vehicle stopping device which can be folded so as to be easily stored in the trunk of a law enforcement vehicle.

It is a further object of the present invention to provide a vehicle stopping device which can be deployed by a single person.

It is still another object of the present invention to provide a vehicle stopping device which is easy to use, easy to manufacture and relatively inexpensive.

These and other objects and advantages of the present invention will become apparent from a reading of the attached specification and appended claims.

SUMMARY OF THE INVENTION

The present invention is a vehicle stopping device having a panel of material which has a tactile leading edge. The panel of material has a size which, when unfolded, has a width suitable for extending across a roadway. The panel of material can be suitably folded, when not in use, into a concertina.

In the present invention, a split seam extends longitudinally across the panel of material from the leading edge. The split seam extends approximately three quarters of the length of the unfolded length of the panel of material. This split seam splits the panel in half and is located in a middle of the unfolded panel. The panel of material is formed of a light weight material, such as silk.

A reinforcement sash is affixed to the panel of material. This reinforcement sash is formed of a strong flexible material, such as KEVLAR (™). One end of the reinforcement sash is attached to the leading edge and extends in parallel relationship to the split seam toward the rearward end of the panel. The reinforcement sash loops around the end of the split seam so as to extend toward the other side of the panel of material. This reinforcement sash then extends toward the leading edge on the opposite side of the split seam. A V-shaped connector serves to connect the reinforcement sash along the leading edge of the panel.

The tactile leading edge extends along the leading edge of the panel of material widthwise across the panel. This tactile leading edge is formed on both sides of the split seam. The tactile leading edge includes an adhesive blister formed there across. Barbed pins can also be provided on this tactile leading edge so as to allow for the secure engagement with the tire of a fleeing vehicle. In the preferred embodiment of the present invention, a plurality of adhesive blisters extend in a row across the length of the tactile leading edge. The plurality of barbs are positioned between adjacent adhesive blisters.

In use, the panel of material is deployed with the tactile leading edge facing the approaching vehicle. When the vehicle advances, the front tires of the approaching vehicle will contact the tactile leading edge so as to bond the leading edge to the tire. As the vehicle continues, the wheels will rotate so as to wrap the panel of material, and its associated reinforcement sash, around the wheels. When the panel reaches the limits of the split, a tight restricting action will occur on the wheels of the vehicle so as to cause an immediate braking force.

DETAILED DESCRIPTION OF THE INVENTION

Figure 1:
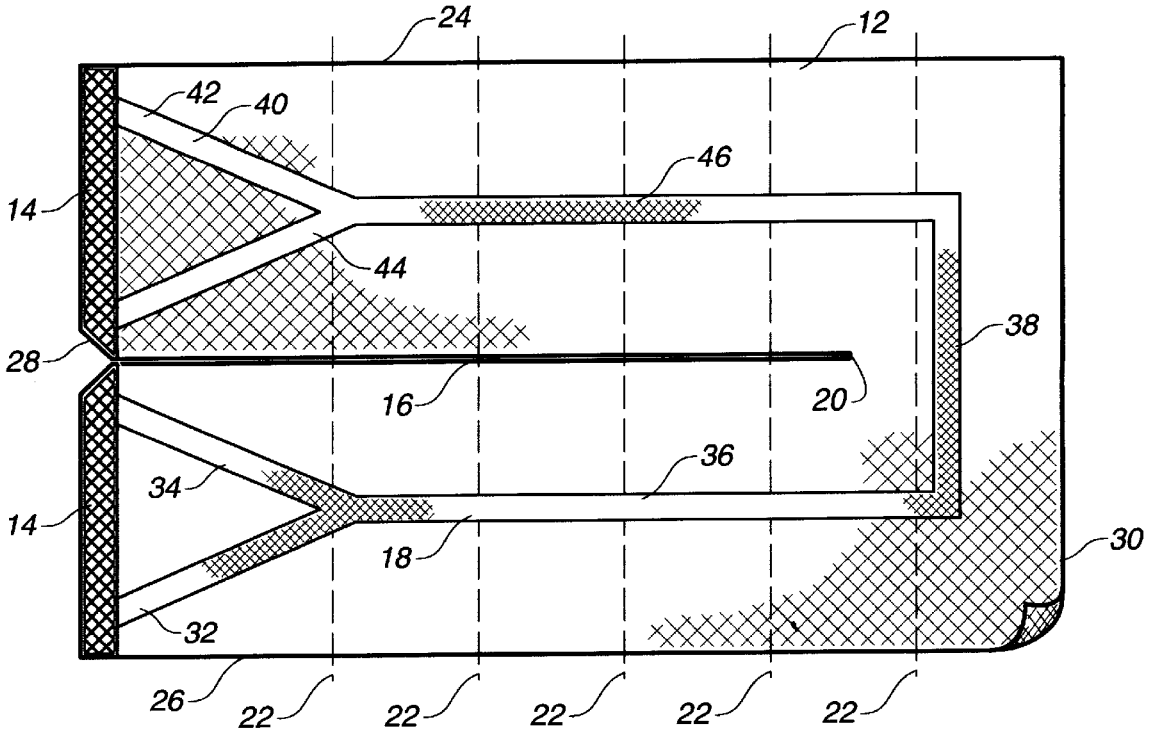
FIG. 1 is a plan view of the vehicle stopping device in accordance with the teachings of the present invention.

Referring to FIG. 1, there is shown at 10 the vehicle stopping device in accordance with the teachings of the present invention. The vehicle stopping device 10 includes a panel of material 12 having a tactile leading edge 14. A split seam 16 extends longitudinally across the panel 12 for less than the length of the panel 12. A reinforcement sash 18 extends from the leading edge 14 on one side of the split seam 16, loops around the end 20 of the split seam 16, and returns back to the leading edge 14 on the opposite side of split seam 16.

As can be seen in FIG. 1, the panel of material 12 has a rectangular configuration. This panel of material should be of a very light weight fabric, such as silk. The panel 12 can be folded along fold lines 22 and across the split seam 16 so as to reside in a concertina folded arrangement. As such, the panel 12 can be easily stored in the trunk of a law enforcement vehicle. The panel 12 should have an unfolded width that is suitable for extending across a roadway. In the preferred embodiment of the present invention, the unfolded panel will have a width suitable for extending across a single lane. In the preferred embodiment of the present invention, the panel 12 will be approximately eighteen feet long.

The tactile leading edge 14 is located at one end of the panel 12. The tactile leading edge 14 extends from side 24 to side 26 of the panel 12. The leading edge 14 is located on both sides of the split seam 16. A V-shaped noticed notch 28 will extend from the leading edge 14 toward the split seam 16. As will be described hereinafter, the tactile leading edge 14 can include barbed pins extending upwardly therefrom and/or adhesive blisters extending there across. The tactile leading edge 14 will extend widthwise across the panel 12.

The split seam 16, in the preferred embodiment, will extend approximately three-quarters of the length of the unfolded panel 12. The split seam 16 will terminate at end 20 inwardly from the rear end 30 of the panel 12. The split seam 16 is actually split or is weakly held together. The split seam 16 extends longitudinally through the middle of the panel 12.

The reinforcement sash 18 has a particular configuration so as to allow the device 10 to effectively brake a fleeing vehicle. The reinforcement sash 18 should be of a strong flexible material, such as KEVLAR (™). The reinforcement sash 18 should be affixed to the surface of the panel 12. One end 32 of the reinforcement sash 18 is affixed to the leading edge 14 on one side of the split seam 16. The reinforcement sash 18 specifically has a V-shaped configuration 34 at the leading edge 14. The wide end of the V-shaped configuration 34 is affixed to the leading edge 14 such that one leg of the V-shaped configuration is adjacent to the split seam 16 and the opposite leg will be adjacent to the side 26 of panel 12. Each of the legs of the V-shaped configuration converge together in a central area 36 which extends lengthwise across the panel 12 along one side of the split seam 16. The reinforcement sash 18 has a looped section 38 which will extend around the end 20 of the split seam 16 so as to emerge on the opposite side of the split seam. It can be seen that the opposite side of the split seam also has the reinforcement sash 18 with a V-shaped section 40. The V-shaped section 40 has a first leg 42 adjacent to the side 24 of panel 12 and an opposite leg 44 adjacent to the split seam 16. Each of the legs 42 and 44 are affixed to the leading edge 14. The legs 42 and 44 converge together to the linear portion 46. The reinforcement sash 18 should be integrally formed together.

Figure 2:
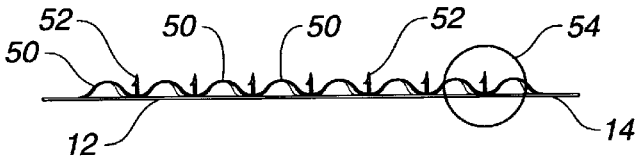
FIG. 2 is an end view of the leading edge of the device of FIG. 1.

FIG. 2 shows the arrangement of the leading edge 14. As can be seen, the leading edge 14 has a plurality of adhesive blisters 50 extending upwardly from the surface of panel 12. Barbed pins 52 also extend upwardly from the panel 12 between adjacent pairs of adhesive blisters. It is important to note that, in the present invention, the barbs 52 and the blisters 50 can be arranged in any desired pattern. However, in the preferred embodiment of the present invention, the barbs 52 will be positioned between adjacent pairs of adhesive blisters.

Figure 3:
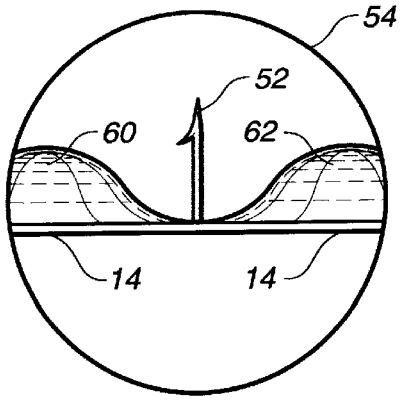
FIG. 3 is a magnified view of the circled area of FIG. 2 showing the arrangement of barbs and adhesive blisters.

FIG. 3 shows the circled area 54 of FIG. 2. As can be seen, the barbed pin 52 extends upwardly between an adhesive blister 60 and another adhesive blister 62. When a tire rolls over the leading edge 14, the barbed pin 52 will engage the tire of the vehicle. Simultaneously, the adhesive blisters 60 and 62 will break open so as to apply a fast-drying adhesive between the panel 12 and the surface of a tire. As such, the present invention provides a two-way manner of connecting the leading edge 14 to the surface of the tire.

Figure 4:
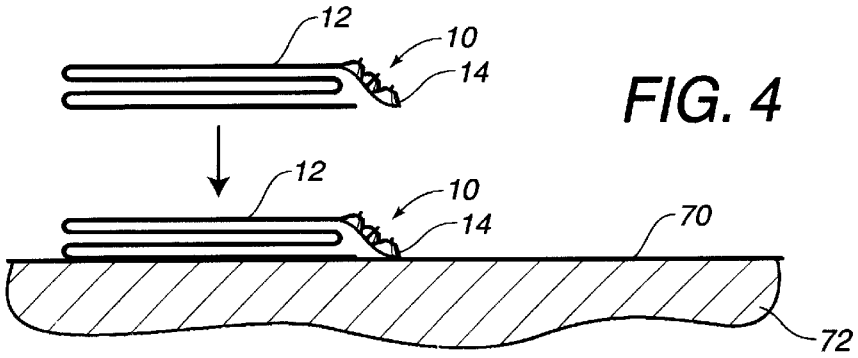
FIG. 4 is a side elevational view showing the deployment of the vehicle stopping device onto a roadway.

FIG. 4 shows the manner in which the device 10 can be applied to a surface 70 of a roadway 72. As can be seen, the panel 12 is unfolded into a flat condition. The leading edge 14 is deployed so as to be facing the approaching vehicle. The panel 12 will stretch flat across the surface 70 of the roadway 72.

Figure 5:
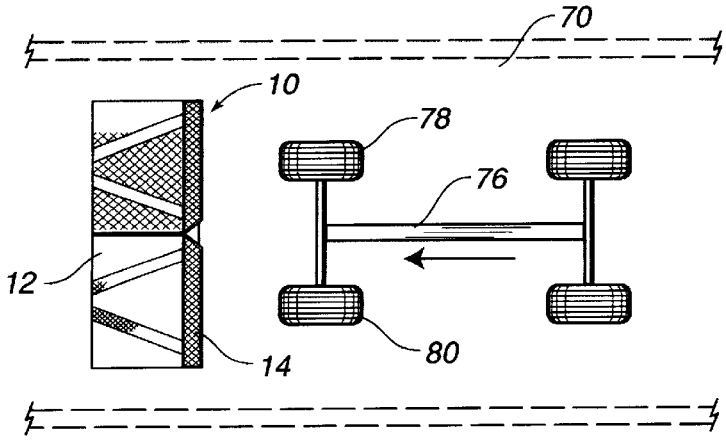
FIG. 5 shows the deployment of the device in relation to an approaching vehicle.

FIG. 5 shows a vehicle 76 approaching the device 10 of the present invention. As can be seen, the front wheels 78 and 80 of the vehicle 76 are approaching the leading edge 14 of the panel 12. As such, the wheels 78 and 80 are in a suitable position for engaging the tactile leading edge 14. As the vehicle 76 travels onto the leading edge 14, the barbs 52 and the adhesive blisters 50 will act so as to strongly adhere to the wheels 78 and 80. The remaining panel 12 will wrap around the wheels of vehicle 76.

Figure 6:
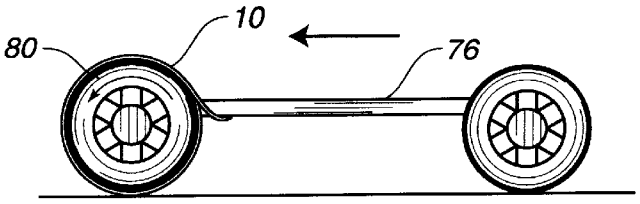
FIG. 6 shows the manner in which the vehicle stopping device wraps around the wheel of a large vehicle so as to effect the braking of the vehicle.

As can be seen in FIG. 6, the device 10 is shown as wrapping around the wheel 80 of the vehicle. The opposite side of the panel will wrap around the wheel 78. As a result, the panel 12, and its associated reinforcement sash 18, will be drawn into the vehicle. The vehicle 76, as illustrated in FIG. 6, is a relatively large vehicle with a long wheelbase. The device 10 will be drawn up under the chassis area. When the system 10 reaches the limits of the split 16, the reinforcement sash will be drawn tight so as to restrict rotation of the wheels and thus cause an immediate braking force.

Figure 7:
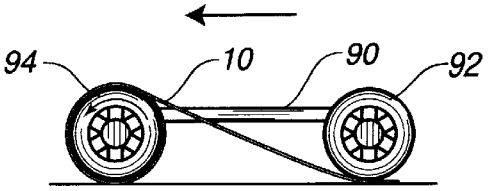
FIG. 7 illustrates the manner in which the vehicle stopping device wraps around the wheel of a small vehicle and engages the rear wheel of the vehicle so as to effect the stopping of the vehicle.

FIG. 7 shows a smaller vehicle 90 encountering the device 10. When a smaller vehicle with a shorter wheelbase contacts the device 10, the leading edge 14 will be drawn around the front wheels in a similar fashion as described hereinbefore. However, the rear wheels 92 will contact the rearward edge 30 of the panel of material 12 before the wrapping effect is fully achieved. As a result, the actual action of the rear wheels 92 will cause the leading edge 14 to cause a braking action on the vehicle. The leading edge will wrap around the front wheel 94 until such time as the wrapping is prevented by contact between the rear wheel 92 and the surface of the panel 12. As such, the front wheel 94 will be prevented from further rotation. The vehicle will come to an immediate stop.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A vehicle stopping device comprising:

a panel of material having a split extending from one end of said panel toward an opposite end of said panel;

a tactile surface formed adjacent said one end of said panel, said tactile surface adapted to attach to a tire rolling thereover; and reinforcement sash affixed to said panel of material and extending in a partial loop extending around said split.

2. The device of claim 1, said split extending longitudinally along said panel of material, said split having an end spaced from said opposite end of said panel of material.

3. The device of claim 2, said split extending for approximately ¾ of a length of said panel of material, said split located in a middle of said panel of material.

4. The device of claim 2, said reinforcement sash having a first end affixed adjacent to said tactile surface, said reinforcement sash having a second end affixed adjacent to said tactile surface on an opposite side of said split from said first end.

5. The device of claim 4, said reinforcement sash extending in parallel relationship to said split on opposite sides of said split, said reinforcement sash extending around said split spaced from said opposite end of said panel of material.

6. The device of claim 4, said reinforcement sash having a V-shaped connector at said first end and a V-shaped connector at said second end, said V-shaped connectors respectively having a wide portion affixed to said tactile surface.

7. The device of claim 1, said panel having a width dimension suitable for extending across a roadway, said tactile surface extending across said width dimension, said panel foldable into a concertina.

8. The device of claim 1, said tactile surface comprising an adhesive applied onto a top surface of said panel material.

9. The device of claim 1, said tactile surface having said adhesive contained in a plurality of blisters, said plurality of blisters adapted to release said adhesive when crushed by the tire rolling thereover.

10. The device of claim 1, said tactile surface comprising a plurality of barbs extending upwardly from a top surface of said panel of material.

11. A vehicle stopping device comprising:

a panel of material having a forward end and a rearward end;

a tactile surface formed adjacent to said first end of said panel material, said tactile surface adapted to attach to a tire rolling thereover; and a reinforcement sash affixed to said panel of material and extending in a partial loop over said panel material, said reinforcement sash having a first end and a second end affixed adjacent to said tactile surface.

12. The device of claim 11, said panel of material having a split extending from said forward end toward said rearward end, said reinforcement sash extending around said split.

13. The device of claim 12, said split having an end spaced from said rearward end, said reinforcement sash extending parallel to said split around said end of said split.

14. The device of claim 13, said split extending approximately three quarters of a length of said panel material, said split located in a middle of said panel of material.

15. The device of claim 14, said first end of said reinforcement sash positioned on an opposite of said split from said second of said reinforcement sash.

16. The device of claim 15, said reinforcement sash having a V-shaped connector at said first end and a V-shaped connector at said second end, said V-shaped connectors respectively having a wide portion affixed to said tactile surface.

17. The device of claim 11, said panel having a width dimension suitable for extending across a roadway, said tactile surface extending across said width dimension, said panel foldable into a concertina.

18. The device of claim 11, said tactile surface comprising an adhesive applied onto a top surface of said panel material.

19. A vehicle stopping device comprising:

a panel of material having a forward end and a rearward end, said panel of material having a dimension suitable for extending across a roadway, said panel of material foldable into a concertina;

a tactile surface formed adjacent to said forward end of said panel of material, said tactile surface adapted to a tire rolling thereover; and a reinforcement sash affixed to said panel of material and extending in a partial loop over said panel of material, said reinforcement sash having a first end and a second end affixed adjacent to said tactile surface.

20. The device of claim 19, said panel of material having a split extending from said forward end to said rearward end, said reinforcement sash extending around said split, said split having an end spaced from said rearward end, said reinforcement sash extending parallel to said split and around said end of said split.

* * * * *